US011988490B2

(12) United States Patent
Pulu

(10) Patent No.: US 11,988,490 B2
(45) Date of Patent: May 21, 2024

(54) FIREWORKS HOLSTER DEVICE

(71) Applicant: Naufahu Pulu, Salt Lake City, UT (US)

(72) Inventor: Naufahu Pulu, Salt Lake City, UT (US)

( * ) Notice: Subject to any disclaimer, the term of this patent is extended or adjusted under 35 U.S.C. 154(b) by 109 days.

(21) Appl. No.: 17/838,843

(22) Filed: Jun. 13, 2022

(65) Prior Publication Data

US 2023/0228543 A1 Jul. 20, 2023

Related U.S. Application Data

(60) Provisional application No. 63/300,851, filed on Jan. 19, 2022.

(51) Int. Cl.
*F42B 4/20* (2006.01)

(52) U.S. Cl.
CPC ..... *F42B 4/20* (2013.01)

(58) Field of Classification Search
CPC ..... F42B 4/20
USPC ..... 102/342
See application file for complete search history.

(56) References Cited

U.S. PATENT DOCUMENTS

| | | | | |
|---|---|---|---|---|
| 128,439 | A * | 6/1872 | Unna | A47B 88/80 312/301 |
| 7,410,135 | B1 * | 8/2008 | Dibble | F42B 4/20 248/220.21 |
| 8,360,446 | B1 * | 1/2013 | Hertan | B62B 3/005 280/47.35 |
| 10,750,863 | B2 * | 8/2020 | Nugent | A47B 88/70 |
| 11,709,039 | B1 * | 7/2023 | Clevenger | F42B 4/20 102/361 |
| 2013/0169133 | A1 * | 7/2013 | Johnson | A47B 88/70 312/298 |

* cited by examiner

*Primary Examiner* — John Cooper
(74) *Attorney, Agent, or Firm* — Brennan, Manna & Diamond, LLC

(57) ABSTRACT

The present invention relates to a novel fireworks safety device. The device is an adjustable tool for securing fireworks in an upright position. The device comprises a square-shaped base component of wood or metal with openings on top to retain fireworks. The device also comprises a sliding tray component and at least one chamber to separate the sliding tray component away from other portions of the device. The sliding tray component slides to adjust to secure different sizes and amounts of fireworks. Further, the device is portable via an attached carrying strap for easy transportation.

17 Claims, 6 Drawing Sheets

FIREWORKS HOLSTER DEVICE

CROSS-REFERENCE TO RELATED APPLICATION

The present application claims priority to, and the benefit of, U.S. Provisional Application No. 63/300,851, which was filed on Jan. 19, 2022 and is incorporated herein by reference in its entirety.

FIELD OF THE INVENTION

The present invention relates generally to the field of fireworks safety devices. More specifically, the present invention relates to an improved fireworks safety device that provides users with a storage unit for fireworks capable of keeping them secure and upright when being ignited. Accordingly, the present disclosure makes specific reference thereto. Nonetheless, it is to be appreciated that aspects of the present invention are also equally applicable to other like applications, devices and methods of manufacture.

BACKGROUND

By way of background, this invention relates to improvements in fireworks safety devices. Specifically, the devices hold fireworks in a proper position while the fireworks are ignited. Devices for safely igniting fireworks are generally desired in the art because they reduce personal injuries and property damage. One particular area of concern is multiple-shot fireworks that shoot one starburst after another into the air until the firework is spent. A problem with this type of firework is that the launch of an initial starburst can undesirably reposition the firework causing the next starburst to be fired in an unintended direction. Further, misfired fireworks can create a fire hazard and end up harming people and potentially burning down nearby buildings and/or houses.

Furthermore, most multiple shot fireworks are in the form of a plurality of side-by-side vertical tubes or a long single tube such as the traditional roman candle. These multiple shot fireworks are sold in a wide variety of sizes and configurations. Those who ignite these types of fireworks desire a holder that is able to accommodate the wide variety of sizes and shapes for these fireworks. Accordingly, people need to be incredibly careful when lighting the fireworks or risk serious injury.

Another problem is that people who ignite fireworks like to take the fireworks to different places. However, transporting and lighting fireworks can be a dangerous process. Thus, a fireworks safety holder should be portable so that the person does not find it bothersome to use in different locations. The safety holder should also be inexpensive enough to not deter people from purchasing the holder.

Specifically, the present invention relates to a safety holder that may be used with a multiple shot firework or a rocket-type firework. The device secures fireworks in an upright position. The device also secures different sizes and amounts of fireworks. Furthermore, the device includes a carrying strap for easy transportation.

Therefore, there exists a long felt need in the art for a fireworks safety device that provides users with a storage unit for fireworks capable of keeping them secure and upright when being ignited. There is also a long felt need in the art for a fireworks safety device that allows users to adjust a sliding tray to accommodate several rows of fireworks. Further, there is a long felt need in the art for a fireworks safety device that provides a sliding tray securable via a locking pin. Moreover, there is a long felt need in the art for a device that keeps the fireworks stable and upright to prevent them from falling over when ignited. Further, there is a long felt need in the art for a fireworks safety device that reduces the chance of any misfiring and improves safety when lighting fireworks for special occasions. Finally, there is a long felt need in the art for a fireworks safety device that includes a convenient carrying strap for easy transportation when not in use.

The subject matter disclosed and claimed herein, in one embodiment thereof, comprises a fireworks safety device. The device is an adjustable tool for securing fireworks in an upright position. The device comprises a square-shaped base component of wood or metal with openings on top to retain fireworks. The device also comprises a sliding tray component and at least one chamber to separate the sliding tray component away from other portions of the device. The sliding tray component slides to adjust to secure different sizes and amounts of fireworks. Further, the device is portable via an attached carrying strap for easy transportation.

In this manner, the fireworks safety device of the present invention accomplishes all of the forgoing objectives and provides users with a device that prevents fireworks from falling over when ignited. The device allows a user to safely store and ignite multiple sizes of fireworks without injury. The device allows users to insert fireworks into the sliding tray component, secure them in an upright position, and safely ignite them for enjoyment on special occasions.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a fireworks safety device. The device is an adjustable tool for securing fireworks in an upright position. The device comprises a square-shaped base component with openings on top to retain fireworks. The device also comprises a sliding tray component and at least one chamber to separate the sliding tray component away from other portions of the device. The sliding tray component slides to adjust to secure different sizes and amounts of fireworks within the device.

The present invention provides a safety holder for fireworks. The safety holder is adjustable and may be used with fireworks of different sizes and shapes. The adjustability is accomplished by providing a base component with a sliding tray component which moves in and out. A retaining device such as a locking pin is used to maintain the position of the sliding tray component against a firework.

In one embodiment, the base component comprises a square-shaped configuration with an opening. Specifically, the base component comprises a bottom and a first set of opposing sides. The first set of opposing sides extend up and over the opening, creating channels for the ends of the sliding tray component to travel in. Further, the base component comprises a back wall and a front opening for accepting the sliding tray component. In one embodiment, the opening is partitioned into one or more chambers, depending on the needs and/or wants of a user. The opening can be partitioned in any suitable number of chambers or can be left as one large opening.

In one embodiment, the base component measures 2' 6" squared, 2' squared, or 1' 6" squared, or any other suitable size or shape as is known in the art, depending on the needs and/or wants of a user.

In another embodiment, the sliding tray component comprises a bottom and two extended opposing sides. The extended opposing sides engage with the channels of the base component, allowing the sliding tray component to slide into and out of the base component. Further, the sliding tray component comprises at least one divider component that spans the bottom and is secured to the two extended opposing sides. The divider component contacts the fireworks placed within the tray component and acts to secure the fireworks within the device by securing the fireworks in the base component opening or against one of the chambers. The two extended opposing sides comprise a plurality of through-holes which align with a plurality of through-holes on the first set of opposing sides of the base component. Thus, once the sliding tray component is in position, securing the fireworks, a retaining device such as a locking pin is used to maintain the position of the sliding tray component against the fireworks. Any other suitable securing means can be utilized to secure the tray in position, as is known in the art.

In one embodiment, the back wall of the base component comprises a pair of feet, such that the device can be stood on its side when not in use. Further, instead of a pair of feet, the device comprises a pair of wheels, casters or other movable means as is known in the art for easy transport.

In one embodiment, the base component comprises a plurality of tubes secured within the opening to retain a plurality of thin, tube-shaped multiple shot fireworks and stick-based skyrockets. In this embodiment, the plurality of tubes are positioned in one of the chambers of the base component, with the tubes being adapted to hold these types of stick-based fireworks.

In another embodiment, one of the extended opposing sides comprises a handle or carrying strap for easy transport. Further, the device can comprise any other suitable handle means as is known in the art.

In yet another embodiment, the fireworks safety device is manufactured from heat-sealable plastic or polymers, such as polypropylene or acrylonitrile-butadiene-styrene (ABS), plywood, or metals, such as aluminum, stainless steel, etc.

In yet another embodiment, the fireworks safety device comprises a plurality of indicia.

In yet another embodiment, a method of securing fireworks safely in an upright position for ignition and/or storage is described. The method includes the steps of providing a fireworks safety device comprising a square-shape base component with a sliding tray component for adjustability. The method also comprises positioning fireworks of varying sizes and shapes in the base component. Further, the method comprises securing the fireworks by sliding the tray component against the fireworks. The method comprises igniting the fireworks safely within the device. Finally, transporting the device via the carrying strap.

In yet another embodiment of the present invention, the fireworks safety device is adjustable, such that it may be used to hold a variety of different-sized fireworks. Users insert fireworks into the base component and then secure them in an upright position by sliding the tray against the fireworks, clamping them in place. Further, the device provides a wide, sturdy base that helps prevent the fireworks from tipping over. Thus, users can safely ignite the fireworks for enjoyment on special occasions without worry of accidents and/or injuries.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
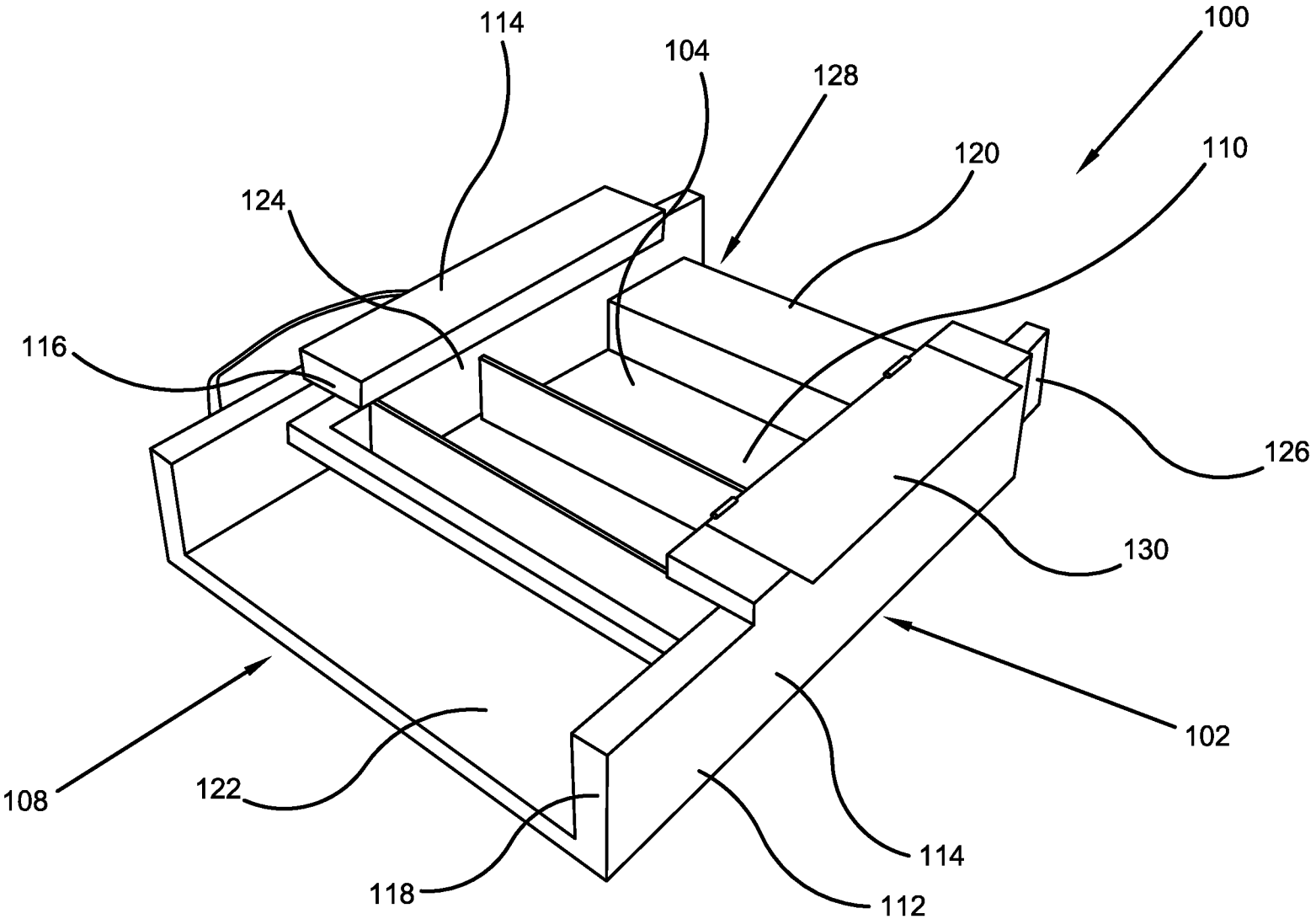
FIG. 1 illustrates a perspective view of one embodiment of the fireworks safety device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art for a fireworks safety device that provides users with a storage unit for fireworks capable of keeping them secure and upright when being ignited. There is also a long felt need in the art for a fireworks safety device that allows users to adjust a sliding tray to accommodate several rows of fireworks. Further, there is a long felt need in the art for a fireworks safety device that provides a sliding tray securable via a locking pin. Moreover, there is a long felt need in the art for a device that keeps the fireworks stable and upright to prevent them from falling over when ignited. Further, there is a long felt need in the art for a fireworks safety device that reduces the chance of any misfiring and improves safety when lighting fireworks for special occasions. Finally, there is a long felt need in the art for a fireworks safety device that includes a convenient carrying strap for easy transportation when not in use.

The present invention, in one exemplary embodiment, is a novel fireworks safety device. The device is an adjustable tool for securing fireworks in an upright position. The device comprises a square-shaped base component of wood or metal with openings on top to retain fireworks. The device also comprises a sliding tray component and at least one chamber to separate the sliding tray component away from other portions of the device. The sliding tray component slides to adjust to secure different sizes and amounts of fireworks. Further, the device is portable via an attached carrying strap for easy transportation. The present invention also includes a novel method of securing fireworks safely in an upright position for ignition and/or storage. The method includes the steps of providing a fireworks safety device comprising a square-shape base component with a sliding tray component for adjustability. The method also comprises positioning fireworks of varying sizes and shapes in the base component. Further, the method comprises securing the fireworks by sliding the tray component against the fireworks. The method comprises igniting the fireworks safely within the device. Finally, transporting the device via the carrying strap.

Referring initially to the drawings, FIG. 1 illustrates a perspective view of one embodiment of the fireworks safety device 100 of the present invention. In the present embodiment, the fireworks safety device 100 is an improved fireworks safety device that provides users with a storage unit for securing fireworks upright. The device 100 is especially designed to allow any suitable user as is known in the art, to keep fireworks stable and upright when ignited. More specifically, the device 100 comprises a square-shaped base component 102 with an opening 104 on top to retain fireworks 106. The device 100 also comprises a sliding tray component 108 and at least one chamber 110 to separate the sliding tray component 108 away from other portions of the device 100. The sliding tray component 108 slides to adjust to secure different sizes and amounts of fireworks 106 within the device 100.

The sliding tray component 108 allows for the adjustability of the device 100. Specifically, the device 100 is adjustable and may be used with fireworks 106 of different sizes and shapes. Further, the adjustability is accomplished by providing a base component 102 with a sliding tray component 108 which moves in and out. Any suitable adjusting means as is known in the art can be utilized to make the device adjustable, such as a clamp, elastic bands, etc., as long as the fireworks 106 are secured within the device 100 in an upright position. The device 100 keeps fireworks 106 stable and upright to prevent the fireworks 106 from falling over when ignited and causing accidents and/or injuries.

In one embodiment, the base component 102 comprises a square-shaped configuration with an opening 104. Specifically, the base component 102 comprises a bottom 112 and a first set of opposing sides 114. The first set of opposing sides 114 extend up and over the opening 104, creating channels 116 for the ends 118 of the sliding tray component 108 to travel in. Further, the base component 102 comprises a back wall 120 and a front opening 122 for accepting the sliding tray component 108. In another embodiment, the opening 104 is partitioned into one or more chambers 124, depending on the needs and/or wants of a user. The opening 104 can be partitioned in any suitable number of chambers 124 or can be left as one large opening 104. The chambers 124 separate the tray component 108 away from other portions of the device 100, thus the tray component 108 will slide to adjust to and/or secure different sizes and amounts of fireworks 106.

In one embodiment, the base component 102 measures 8' squared, 8'×4', 2' 6" squared, 2' squared, 1'×8', 1' 6" squared, or 1' squared, or any other suitable size or shape as is known in the art, depending on the needs and/or wants of a user. Further, the base component 102 is configured in a square shape, but could also be configured in a rectangular shape, or any other suitable shape as is known in the arts. The base component 102 weighs approximately at least 3-5 lbs., to withstand the impact of the fireworks 106. Generally, the device 100 can be any suitable size and/or shape as is known in the art, with larger sizes for retaining a large amount of fireworks, such as for commercial use and smaller sizes for retaining a small amount of fireworks, such as for home or private use.

In another embodiment, the back wall 120 of the base component 102 comprises a pair of feet 126, such that the device 100 can be stood on its side when not in use. Further, instead of a pair of feet 126, the device 100 comprises a pair of wheels 128, casters or other movable means as is known in the art for easy transport. Thus, a user can easily move the device 100 without having to carry it.

In another embodiment, the base component 102 comprises a fold-up shield 130 manufactured of plastic, wood, glass, metal, and/or aluminum, etc. The fold-up shield 130 is an extra guard to protect others from the fireworks 106 being ignited in the base component 102. The fold-up shield 130 can be secured to the first set of opposing sides 114 and/or the back wall 120, depending on the needs and/or wants of a user via any suitable securing means as is known in the art.

Figure 2:
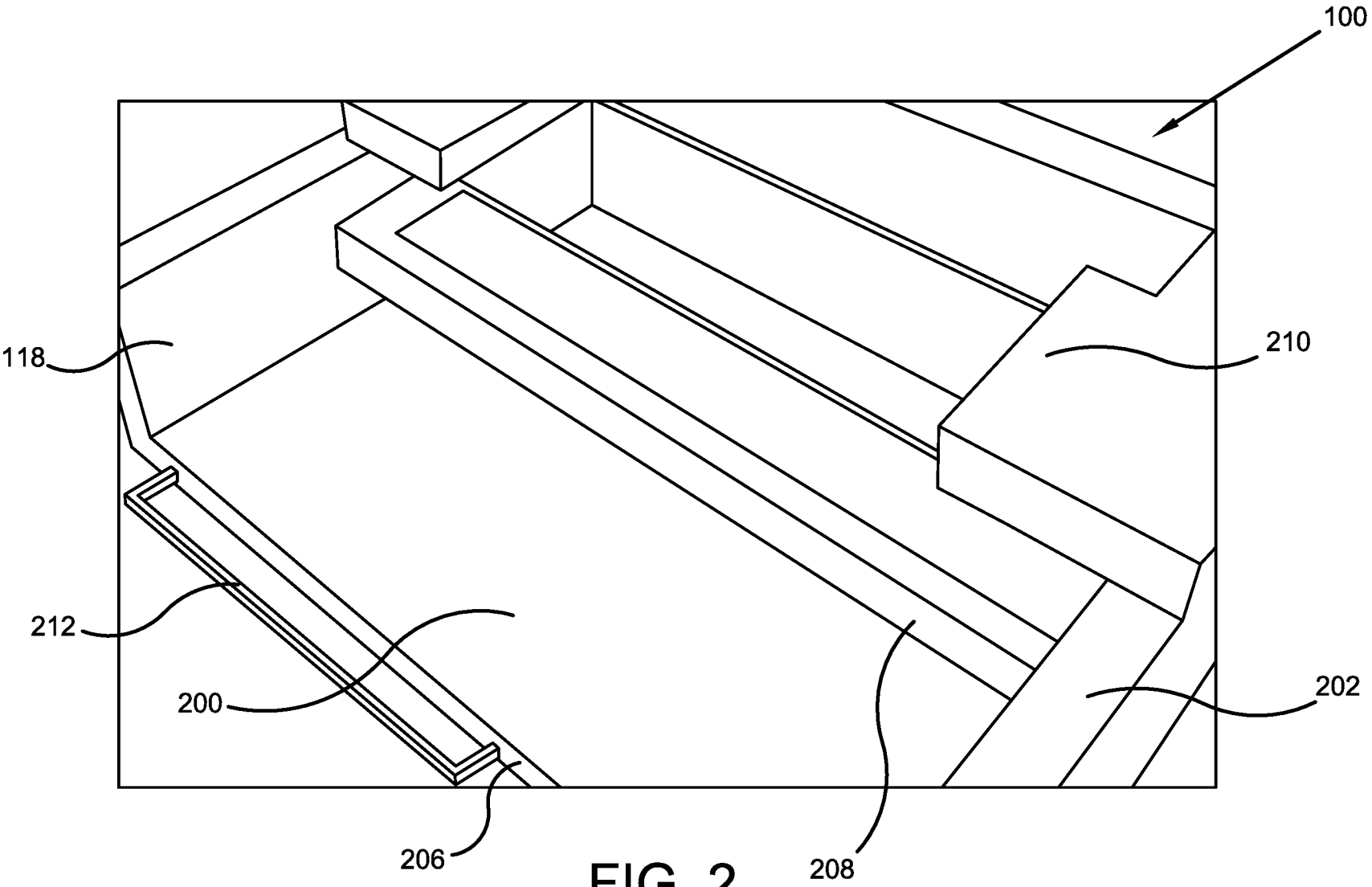
FIG. 2 illustrates a perspective view of one embodiment of the fireworks safety device of the present invention with the tray component slid out in accordance with the disclosed architecture.

As shown in FIG. 2, the sliding tray component 108 comprises a bottom 200 and two extended opposing sides 202. The extended opposing sides 202 engage with the channels 116 of the base component 102, allowing the sliding tray component 108 to slide into and out of the base component 102 freely. In one embodiment, the tray component 108 comprises a handle 204 for ease in sliding the tray 108 in and out. The handle 204 can be any suitable handle as is known in the art and is typically secured to a front 206 of the tray component 108. The handle 204 can be formed as one integral piece with the tray component 108 or secured to the tray component 108 as a separate component via any suitable securing means as is known in the art, such as gluing, welding, screws, bolts, etc.

Furthermore, the sliding tray component 108 comprises at least one divider component 208 that spans the bottom 200 and is secured to the two extended opposing sides 202. The divider component 208 contacts the fireworks 106 placed within the tray component 108 and acts to secure the fireworks 106 within the device 100 by securing the fireworks 106 in the base component 102 opening 104 or against one of the chambers 110. Any number of divider components 208 can be utilized as is known in the art, depending on the size and shape of the fireworks being used. The divider components 208 can be permanently secured to the tray component 108 via any suitable securing means as is known in the art, such as gluing, screws, welding, etc.; or the divider components 208 can be removably secured, such that a user can add the number of divider components 208 as needed and/or wanted and remove any unnecessary dividers 208.

Further, the sliding tray component 108 comprises a top component 210 that slides and applies pressure depending on a gap from the sides 202 to help retain the fireworks 106 in an upright position. The top component 210 also comprises a handle 212 for carrying and transporting. The handle 212 can be any suitable handle as is known in the art and is secured via any suitable securing means as is known in the art.

Figure 3:
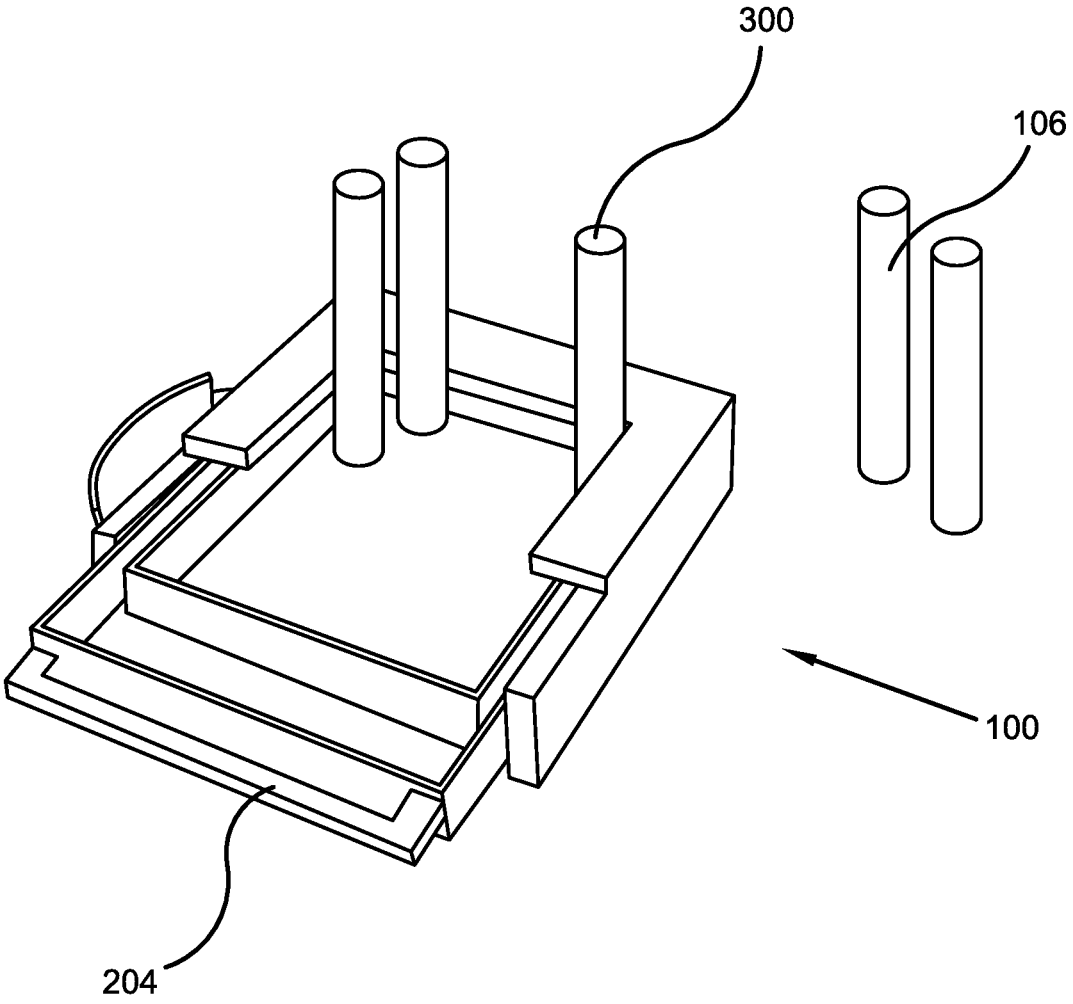
FIG. 3 illustrates a perspective view of one embodiment of the fireworks safety device of the present invention with fireworks inserted in accordance with the disclosed architecture.

As shown in FIG. 3, besides fireworks 106, the base component 102 can comprise a plurality of tubes 300 secured within the opening 104 to retain a plurality of thin, tube-shaped multiple shot fireworks and stick-based skyrockets (not shown). In this embodiment, the plurality of tubes 300 are positioned in one of the chambers 110 of the base component 102, with the tubes 300 being adapted to hold these types of stick-based fireworks. The tubes 300 can be any suitable size and shape as is known in the art, depending on the needs and/or wants of a user. Further, the tubes 300 can be removable and only placed in the base component 102 when needed. Any suitable number of tubes 300 can be utilized as well, depending on the needs and/or wants of a user.

Figure 4:
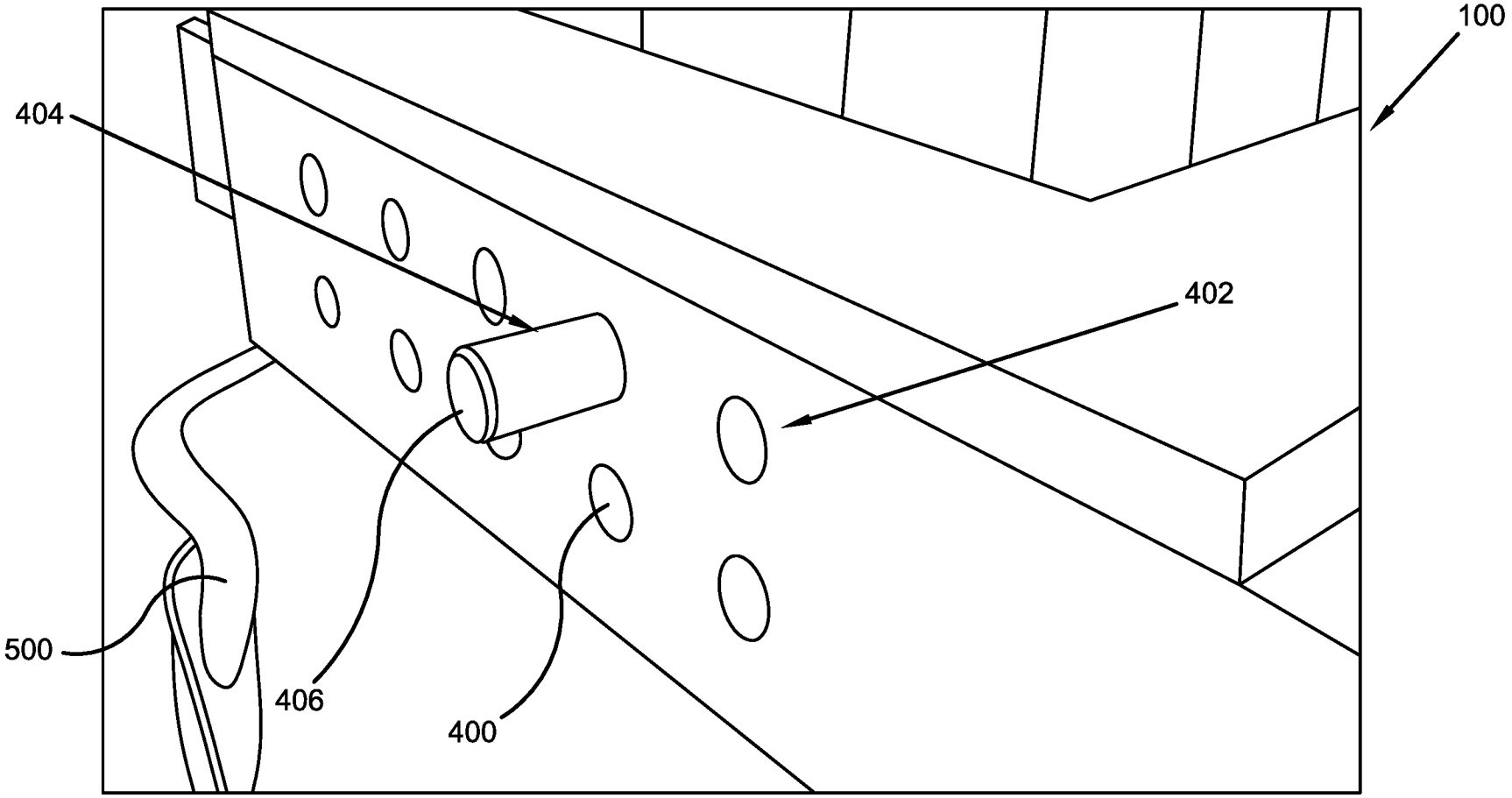
FIG. 4 illustrates a perspective view of one embodiment of the fireworks safety device of the present invention comprising a locking pin for the tray component in accordance with the disclosed architecture.

As shown in FIG. 4, the two extended opposing sides 202 comprise a plurality of through-holes 400 which align with a plurality of through-holes 402 on the first set of opposing sides 114 of the base component 102. Thus, once the sliding tray component 108 is in position, securing the fireworks 106, a retaining device 404 such as a locking pin 406 is used to maintain the position of the sliding tray component 108 against the fireworks 106. Specifically, the locking pin 406 is inserted into the aligned holes 400, 402, which prevents the tray component 108 from sliding out of position and retains the fireworks 106 in an upright position. Any other suitable securing means can be utilized to secure the tray 108 in position, as is known in the art, depending on the needs and/or wants of a user.

Figure 5:
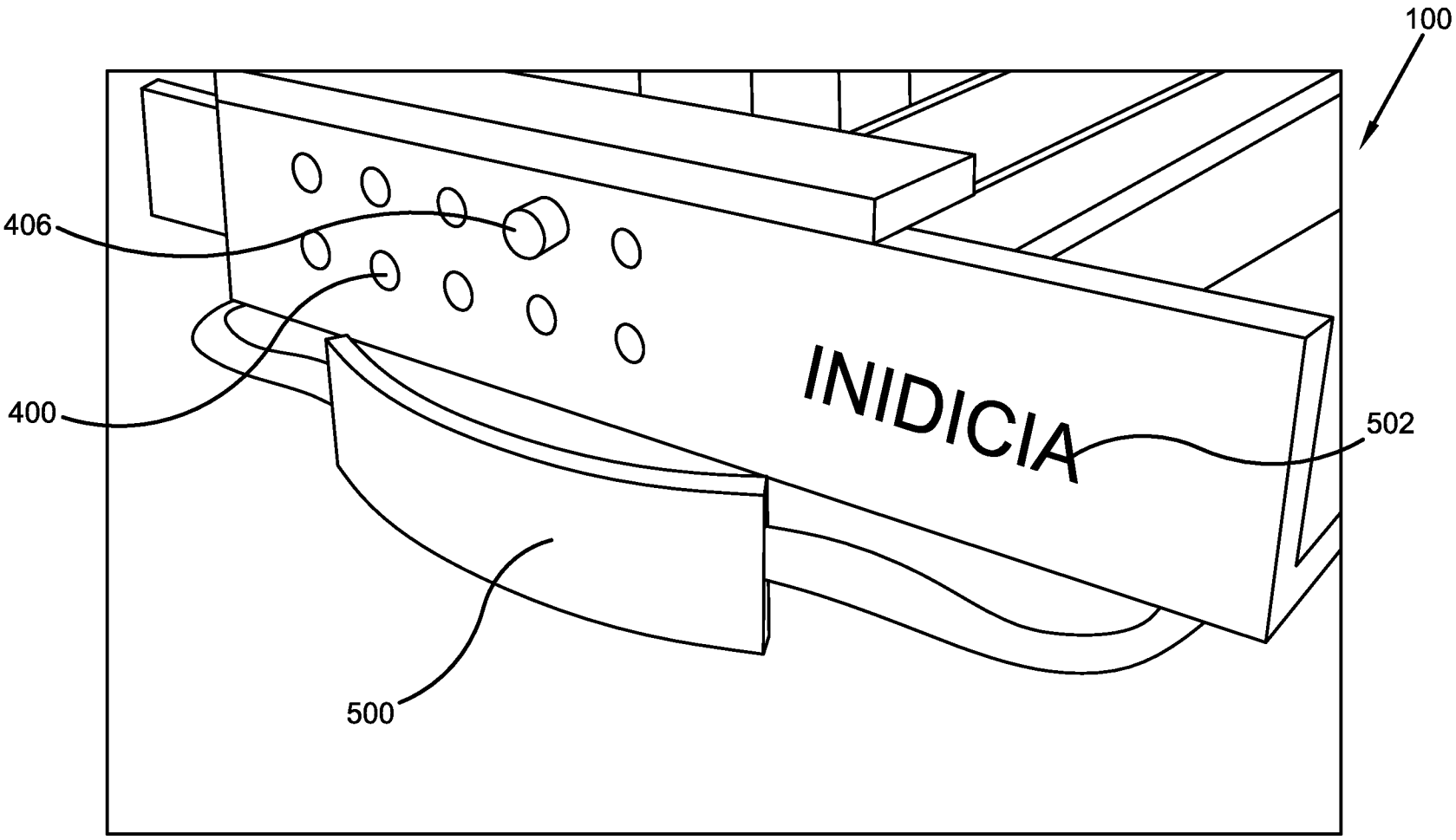
FIG. 5 illustrates a perspective view of one embodiment of the fireworks safety device of the present invention disclosing the carrying strap in accordance with the disclosed architecture.

As shown in FIG. 5, one of the extended opposing sides 202 comprises a handle or carrying strap 500 for easy transport. Further, the device 100 can comprise any other suitable handle means as is known in the art. The handle or carrying strap 500 can also be secured in any suitable fashion as is known in the art, depending on the needs and/or wants of a user.

In yet another embodiment, the fireworks safety device 100 is manufactured from plywood, metal, glass, carbon fiber, aluminum, acrylic, ABS, Polypropylene, Polyethylene, Polystyrene, PVC, Clear Acrylic Sheets, Aluminum Composite (ACM), HDPE, Polycarbonate Mirror, Polypropylene Sheet, Ultra High Molecular Weight Polyethylene (UHMW-PE), Acetal sheet, PETG, HDPE, and plastic, etc., or any other suitable material as is known in the art.

In yet another embodiment, the fireworks safety device 100 comprises a plurality of indicia 502. Specifically, the base component 102 of the device 100 may include advertising, a trademark, or other letters, designs, or characters, printed, painted, stamped, or integrated into the base component 102 or tray component 108, or any other indicia 502 as is known in the art. Specifically, any suitable indicia 502 as is known in the art can be included, such as but not limited to, patterns, logos, emblems, images, symbols, designs, letters, words, characters, animals, advertisements, brands, etc., that may or may not be fireworks or brand related.

In use, the fireworks safety device 100 is adjustable, such that it may be used to hold a variety of different-sized fireworks 106. Users insert fireworks 106 into the base component 102 and then secure them in an upright position by sliding the tray 108 against the fireworks 106, clamping them in place. Further, the device 100 provides a wide, sturdy base 102 that helps prevent the fireworks 106 from tipping over. Thus, users can safely ignite the fireworks 106 for enjoyment on special occasions without worry of accidents and/or injuries.

Figure 6:
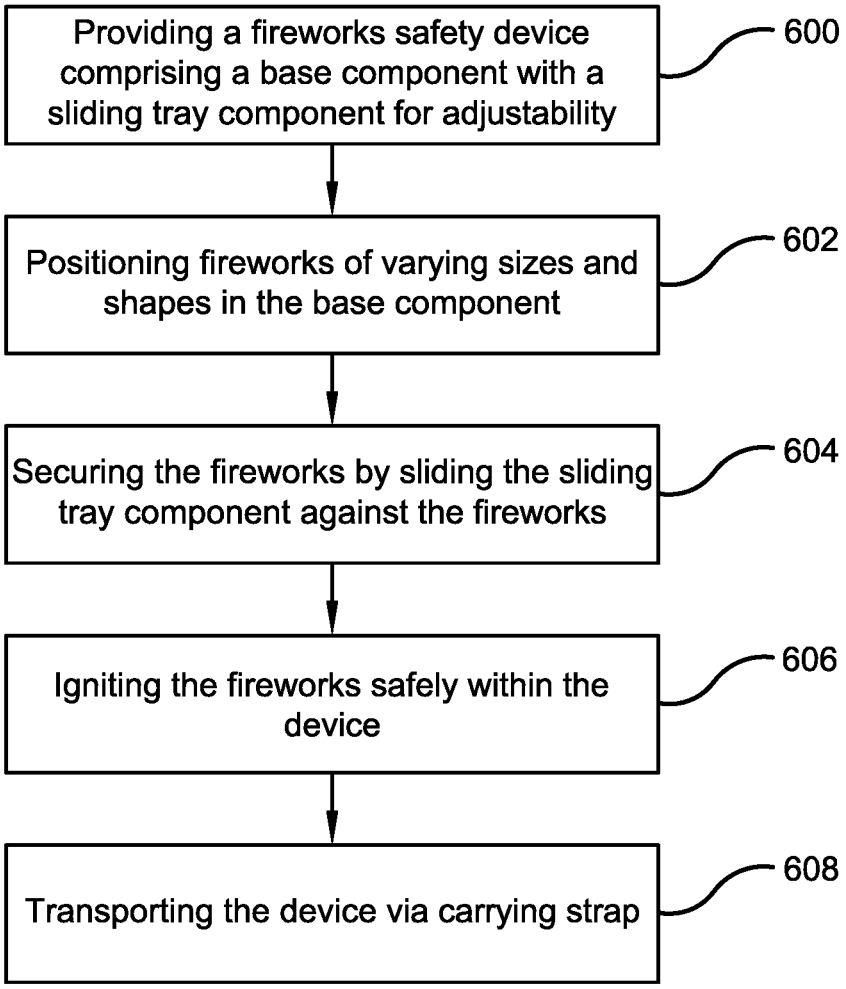
FIG. 6 illustrates a flowchart showing the method of securing fireworks safely in an upright position for ignition and/or storage in accordance with the disclosed architecture.

FIG. 6 illustrates a flowchart of the method of securing fireworks safely in an upright position for ignition and/or storage. The method includes the steps of at 600, providing a fireworks safety device comprising a square-shape base component with a sliding tray component for adjustability. The method also comprises at 602, positioning fireworks of varying sizes and shapes in the base component. Further, the method comprises at 604, securing the fireworks by sliding the tray component against the fireworks. The method comprises at 606, igniting the fireworks safely within the device. Finally, at 608, transporting the device via the carrying strap.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "fireworks safety device", "fireworks device", and "device" are interchangeable and refer to the fireworks safety device 100 of the present invention.

Notwithstanding the forgoing, the fireworks safety device 100 of the present invention can be of any suitable size and configuration as is known in the art without affecting the overall concept of the invention, provided that it accomplishes the above stated objectives. One of ordinary skill in the art will appreciate that the fireworks safety device 100 as shown in FIGS. 1-6 is for illustrative purposes only, and that many other sizes and shapes of the fireworks safety device 100 are well within the scope of the present disclosure. Although the dimensions of the fireworks safety device 100 are important design parameters for user convenience, the fireworks safety device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A fireworks safety device to keep a plurality of fireworks stable and upright when ignited, the fireworks safety device comprising:

a base component with an opening; wherein the base component comprises a bottom and a first set of opposing sides; and a sliding tray component;

wherein the sliding tray component slides within the base component;

wherein the sliding tray component slides to adjust to and secure different sizes and amounts of the plurality of fireworks within the fireworks safety device; and further wherein the first set of opposing sides extend up and over the opening, creating channels for ends of the sliding tray component to travel in.

2. The fireworks safety device of claim 1, wherein the base component comprises a back wall and a front opening for accepting the sliding tray component.

3. The fireworks safety device of claim 2, wherein the back wall of the base component comprises a pair of feet.

4. The fireworks safety device of claim 2, wherein the back wall of the base component comprises a pair of wheels.

5. The fireworks safety device of claim 2, wherein the sliding tray component comprises a bottom and two extended opposing sides.

6. The fireworks safety device of claim 5, wherein the two extended opposing sides engage with the channels of the base component to allow the sliding tray component to slide into and out of the base component freely.

7. The fireworks safety device of claim 6, wherein the tray component comprises a handle.

8. The fireworks safety device of claim 7, wherein the sliding tray component comprises at least one divider component.

9. The fireworks safety device of claim 8, wherein the base component comprises a plurality of tubes to retain a plurality of thin, tube-shaped fireworks.

10. The fireworks safety device of claim 9, wherein the two extended opposing sides comprise a plurality of through-holes that align with a plurality of through-holes on the first set of opposing sides of the base component.

11. The fireworks safety device of claim 10, wherein once the sliding tray component is in position and securing the plurality of fireworks, a locking pin is used to maintain position of the sliding tray component against the plurality of fireworks.

12. The fireworks safety device of claim 11, further comprising a carrying strap for easy transport of the fireworks safety device.

13. The fireworks safety device of claim 1, wherein the base component comprises a fold-up shield to protect others from the plurality of fireworks being ignited.

14. A fireworks safety device to keep a plurality of fireworks stable and upright when ignited, the fireworks safety device comprising:

a base component with an opening; and a sliding tray component;

wherein the base component comprises a bottom and a first set of opposing sides which extend up and over the opening, creating channels for ends of the sliding tray component to travel in, and a back wall and a front opening for accepting the sliding tray component;

wherein the sliding tray component comprises a bottom and two extended opposing sides, which engage with the channels of the base component, allowing the sliding tray component to slide into and out of the base component freely, and at least one divider component; and further wherein the sliding tray compartment slides to adjust to secure different sizes and amounts of fireworks within the fireworks safety device.

15. The fireworks safety device of claim 14 wherein the base component comprises a fold-up shield to protect others from the plurality of fireworks being ignited.

16. The fireworks safety device of claim 14 further comprising a plurality of indicia.

17. A method of securing a plurality of fireworks safely in an upright position for ignition and/or storage, the method comprising the steps of:

providing a fireworks safety device comprising a base component with a sliding tray component for adjustability;

positioning the plurality of fireworks of varying sizes and shapes in the base component;

securing the plurality of fireworks by sliding the sliding tray component against the plurality of fireworks;

igniting the plurality of fireworks safely within the fireworks safety device; and transporting the fireworks safety device via a carrying strap.

* * * * *